US006637392B2

(12) United States Patent
Jung

(10) Patent No.: US 6,637,392 B2
(45) Date of Patent: Oct. 28, 2003

(54) METHOD FOR CONTROLLING A GLOW PLUG FOR DIESEL ENGINE

(75) Inventor: Jae-Yoon Jung, Kwangmyung (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 09/957,586

(22) Filed: Sep. 20, 2001

(65) Prior Publication Data

US 2002/0033155 A1 Mar. 21, 2002

(30) Foreign Application Priority Data

Sep. 20, 2000 (KR) ..... 2000-55108

(51) Int. Cl.[7] ..... F02P 19/02

(52) U.S. Cl. ..... 123/145 A; 123/406.54; 123/406.55

(58) Field of Search ..... 123/406.53, 406.54, 123/406.55, 491, 145 A, 169 R

(56) References Cited

U.S. PATENT DOCUMENTS

| | | | | | |
|---|---|---|---|---|---|
| 4,375,205 | A | * | 3/1983 | Green | 123/179.21 |
| 4,399,781 | A | * | 8/1983 | Tsukasaki | 123/179.21 |
| 4,511,792 | A | * | 4/1985 | Kawamura | 219/499 |
| 4,566,410 | A | * | 1/1986 | Demizu | 123/179.6 |
| 4,658,772 | A | * | 4/1987 | Auth et al. | 123/145 A |
| 4,762,982 | A | * | 8/1988 | Ohno et al. | 219/508 |
| 4,939,347 | A | * | 7/1990 | Masaka et al. | 219/492 |
| 5,144,922 | A | * | 9/1992 | Kong | 123/145 A |
| 5,241,929 | A | * | 9/1993 | Grassi et al. | 123/145 A |
| 6,009,369 | A | * | 12/1999 | Boisvert et al. | 701/99 |

FOREIGN PATENT DOCUMENTS

| | | | | |
|---|---|---|---|---|
| JP | 360159350 | * | 8/1985 | F02D/41/40 |
| JP | 32252 | * | 2/1987 | F02D/41/40 |
| JP | 362129548 | * | 6/1987 | F02D/41/40 |
| JP | 285672 | * | 11/1989 | F02P/19/02 |
| JP | 263216 | * | 9/2001 | F02D/45/00 |

* cited by examiner

*Primary Examiner*—Hieu T. Vo
*Assistant Examiner*—Hai Huynh
(74) *Attorney, Agent, or Firm*—Christie, Parker & Hale, LLP

(57) ABSTRACT

For the purpose of precisely controlling a power supply to the glow plug and thereby reducing unnecessary power consumption, and stopping a control logic for a time when a battery voltage is low and thereby preventing a engine stall, the present invention provides a method for dividing an engine starting step into a cranking step and an idling step, controlling power supplied to the glow plug, and operating the glow plug even after successfully entering into a running state in the case of entering into an abnormal engine state based on an amount of injected fuel, an engine speed and a coolant temperature, and thereby controlling the glow plug from before the engine starts through after it is running.

11 Claims, 5 Drawing Sheets

Post-preheating

Instantaneous preheating

Fig.7

Table of initial preheating time

| Coolant temperature \ Battery voltage | 10V | 15V |
|---|---|---|
| 30 °C | 2sec | 1sec |
| 20 °C | 3sec | 1.5sec |
| −10 °C | 5sec | 5sec |
| −20 °C | 15sec | 15sec |

Fig.8

Table of main preheating time

| Coolant temperature \ Battery voltage | 10V | 15V |
|---|---|---|
| 30 °C | 4sec | 2sec |
| 20 °C | 6sec | 3sec |
| −10 °C | 10sec | 10sec |
| −20 °C | 30sec | 30sec |

METHOD FOR CONTROLLING A GLOW PLUG FOR DIESEL ENGINE

CROSS-REFERENCE TO RELATED APPLICATION

This application claims priority of Korea patent Application No. 10-2000-0055108, filed on Sep. 20, 2000.

BACKGROUND OF THE INVENTION (a) Field of the Invention

The present invention relates to a method for controlling a glow plug, and more particularly, to a method for controlling power supplied to the glow plug by dividing an engine starting step into a cranking step and an idling step, and operating the glow plug even after successfully entering into a running state in the case of entering into an abnormal engine state based on an amount of injected fuel, an engine speed and a coolant temperature, and thereby controlling the glow plug from before the engine starts through after it is running.

(b) Description of the Related Art

A conventional diesel engine is a compression-ignition type engine, which ignites fuel by injecting it into a combustion chamber heated to a high temperature by compressing air in a cylinder. Ignition of the conventional diesel engine may be unstable when the engine is at a low temperature in an early state of engine starting in which the engine is cold, because compression heat is not sufficient.

To enhance startability of a diesel engine when it is cold, a glow plug is installed in each cylinder and operated before starting the engine in order to heat air around the glow plug.

A conventional method for controlling a glow plug by prior art is simply to heat the glow plug for a given period of time according to coolant temperature.

According to the prior art, there is a problem of high power consumption. For example, the glow plug heating is continued in an unnecessary situation because the heating time is unchangeably determined by data acquired during starting. Therefore the battery may be frequently discharged because of high power consumption and the engine can be stalled in the process of starting because too much electrical power stored in the battery can be consumed by heating the glow plug.

SUMMARY OF THE INVENTION

Therefore, the present invention has been made in an effort to solve the above problem. An object of the present invention is to provide a method for controlling power supplied to a glow plug by dividing an engine starting step into a cranking step and an idling step, and operating the glow plug in the case of entering into an abnormal engine state even after successfully entering into a running state, based on an amount of injected fuel, engine speed and coolant temperature, and thereby controlling the glow plug from before the engine starts through after it is running, and stopping the process of control for a short time when a battery voltage is low.

Generally, a starter motor is rotated by operating a start switch, and thereby starting begins. The process of engine starting is made up of a cranking step in which the engine starts to rotate and an idling step in which the engine idles immediately after the engine is started.

Therefore, to achieve the above object, the method for controlling the glow plug according to the present invention controls power supplied to the glow plug by dividing the engine starting step into the cranking step and the idling step. Furthermore, the glow plug is operated even after the engine successfully starts, when the engine is in an abnormal state based on an amount of injected fuel, engine speed and coolant temperature.

A preheating system using a method for controlling a glow plug according to the present invention includes the glow plug being fixed on one side of a cylinder head, a battery supplying power to the glow plug, a control unit controlling power supply from the battery to the glow plug through a relay, a coolant temperature sensor measuring the temperature of the coolant, a battery voltage sensor measuring the voltage of the battery, and means for measuring an amount of injected fuel.

A method for controlling the glow plug of the present invention applies power to the glow plug until a power supply time exceeds a predetermined initial preheating time, or the engine is cranked, at which time the power supply to the glow plug is maintained until the power supply time exceeds a predetermined main preheating time, the engine enters into the idling state, or the coolant temperature is higher than a predetermined target value, and then the power supply to the glow plug is cut off.

The initial preheating time and the main preheating time are determined by tables that use the battery voltage and the coolant temperature as variables.

When the engine speed is greater than a predetermined speed for a predetermined time, the engine is determined to be cranking. When the engine speed reaches a predetermined speed, the engine is determined to be idling.

As the engine starts idling, the amount of injected fuel and the engine speed are measured. When the amount of injected fuel is greater than a predetermined fuel injection reference amount, or the engine speed is greater than a predetermined reference speed, the glow plug is preheated until the amount of fuel being injected and the engine speed become respectively lower than the fuel injection reference amount and the reference speed.

After engine starting is complete, when the coolant temperature is lower than a determined critical temperature, or the amount of injected fuel is less than a determined critical amount of injected fuel, or the engine speed is lower than a determined critical speed, the glow plug is again preheated until the coolant temperature, the amount of injected fuel and the engine speed are respectively greater than the critical values.

In each control step, when the battery voltage being measured is lower than a predetermined critical voltage, the power supply to the glow plug and the execution of the detailed steps are stopped. The power supply to the glow plug and the execution of the detailed steps remain stopped until the battery voltage is higher than the critical voltage, and then the power supply to the glow plug and the execution of the detailed steps are resumed.

BRIEF DESCRIPTION OF THE DRAWINGS

FIG. 7 and FIG. 8 are drawings showing respectively an example of a table that determines an initial preheating time and an example of a table that determines a main preheating time.

DETAILED DESCRIPTION OF THE PREFERRED EMBODIMENTS

Hereinafter, an embodiment of the present invention will be described in detail with reference to the accompanying drawings.

Figure 1:
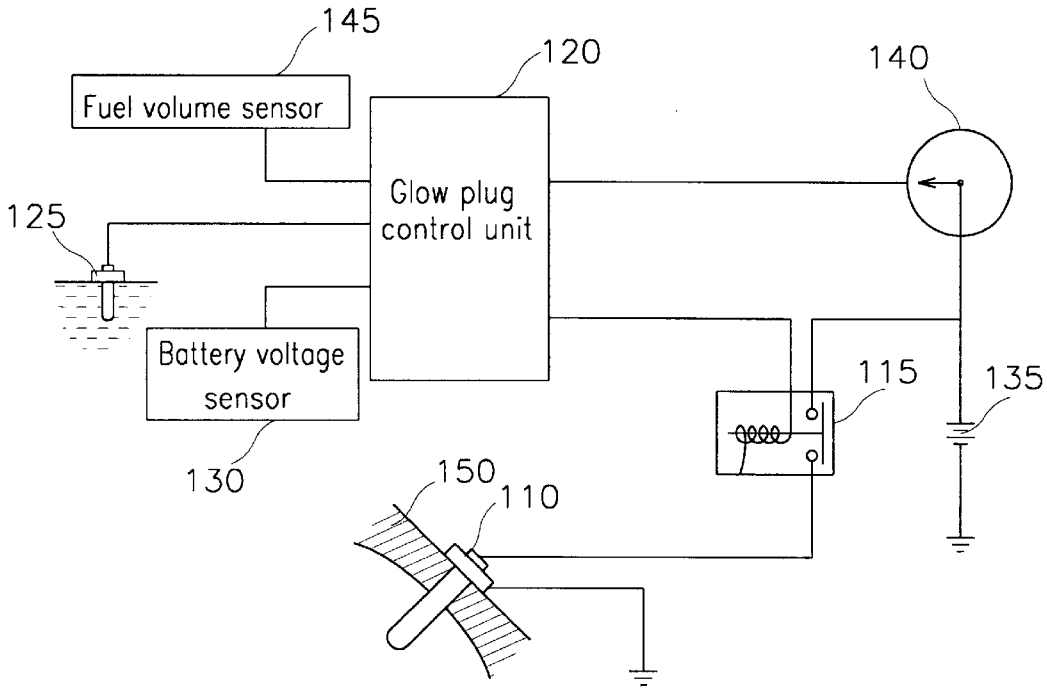
FIG. 1 is a schematic view of a glow plug system in which a method for controlling glow plugs by an embodiment of the present invention is used.

FIG. 1 is a schematic view of a glow plug system in which a method for controlling glow plugs by an embodiment of the present invention is used.

As shown in FIG. 1, the glow plug system according to the embodiment of the preset invention includes a glow plug 110 being fixed on one side of a cylinder head 150, a battery 135 supplying power to the glow plug, a relay 115 being connected to the glow plug 110 and switching a power supply from the battery 135 to the glow plug 110, a glow plug control unit 120 being connected to the relay 115 and controlling an operation of the relay 115, a coolant temperature sensor 125 inputting a variable with which the glow plug control unit 120 controls an operation of the relay 115, a battery voltage sensor 130, and a fuel volume sensor 145 for measuring an amount of injected fuel, and it further comprises a start switch 140 controlling the power supply to the glow plug control unit 120.

The glow plug 110 can be an arbitrary heating device that transforms electrical energy into thermal energy, and the fuel volume sensor 145 for measuring the amount of injected fuel can be any arbitrary device that performs the function.

The start switch 140 includes an 'on' position for supplying power to sensors attached to the engine and a 'start' position for supplying power to a starter motor and thereby rotating the starter motor.

Though the control unit 120 can be a singular control unit controlling the relay 115 by signal inputs from the above sensors 125, 130 and 145, it is preferable that the control unit is an electronic control unit (ECU) also controlling actuators of the engine.

Figure 2:
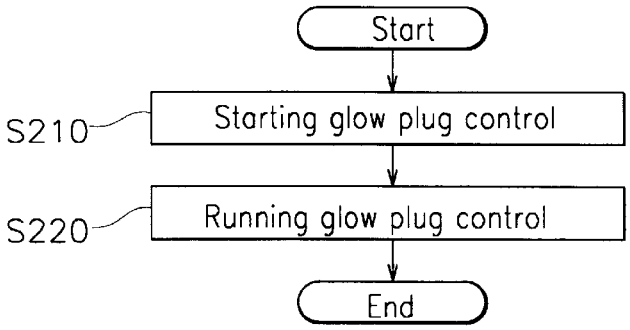
FIG. 2 is a flowchart showing an embodiment of a method for controlling a glow plug of the present invention.

FIG. 2 is a flowchart showing an embodiment of a method for controlling a glow plug of the present invention.

As shown in FIG. 2, a method for controlling the glow plug of the present invention comprises a starting glow plug control step S210 controlling the glow plug for engine starting, and a running glow plug control step S220 controlling the glow plug after engine starting.

Generally, the starter motor is rotated by operating the start switch of the engine, and thereby starting begins. In the starting glow plug control step S210, the engine-starting step is divided into a cranking step in which the engine rotates and an idling step in which the engine starts to idle after the engine is started, and power supplied to the glow plug is controlled from the point of operating the start switch to the point of entering into the idling state. Furthermore, it is determined whether the engine is stable when entering the idling state, and when the engine is determined to be unstable, the glow plug is again actuated.

In the running glow plug control step S220, when the engine is unstable based on the amount of injected fuel, the engine speed and the coolant temperature even after the engine starts idling, the glow plug is operated, and thereby the glow plug can be controlled after engine starting.

While the engine normally operates, running glow plug control step S220 is executed continuously. When the engine start switch 140 is turned off, the running control step S220 ends.

Figure 3:
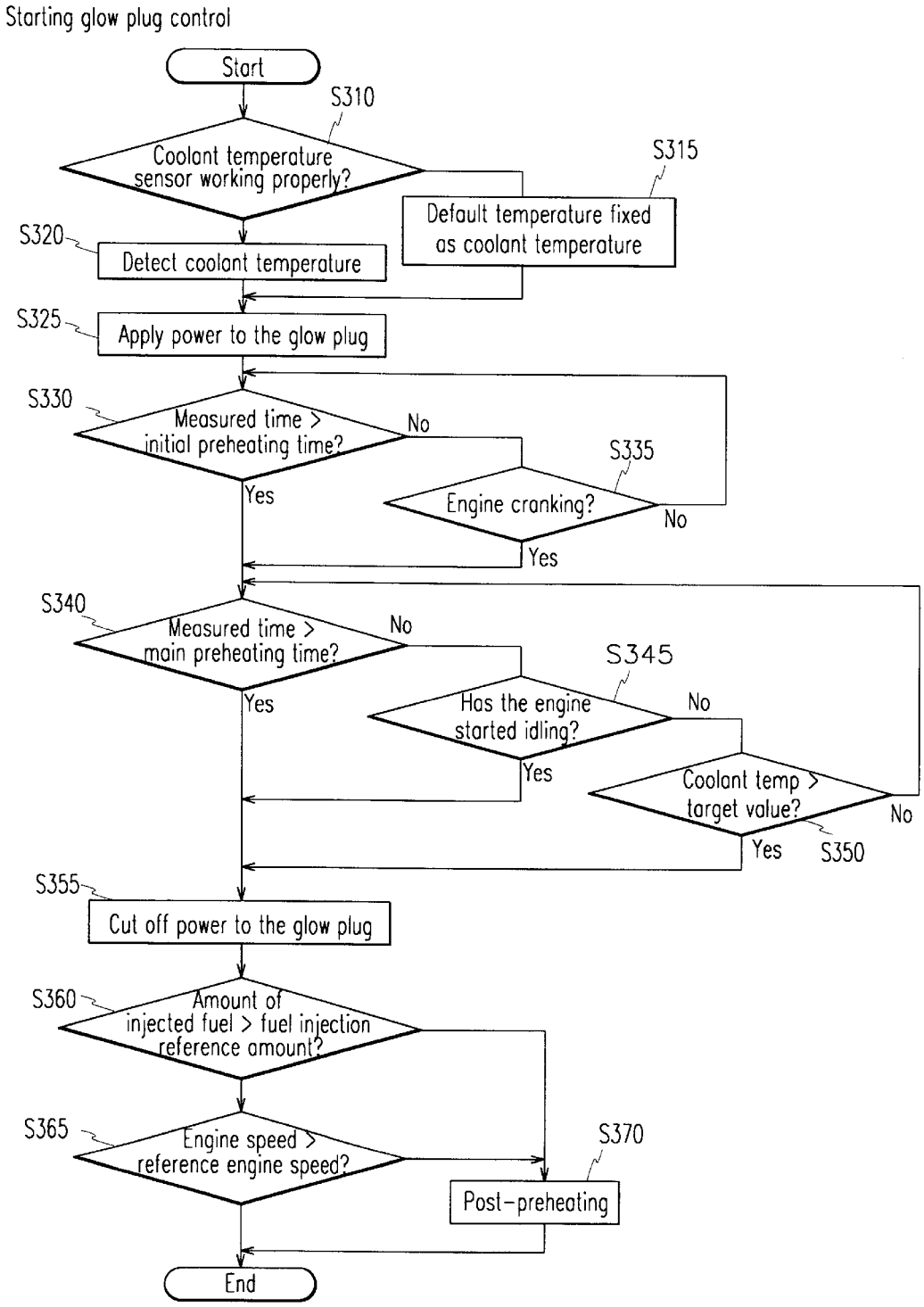
FIG. 3 and FIG. 4 are flowcharts showing respectively a detailed step of a starting glow plug control step and a running glow plug control step.
Figure 4:
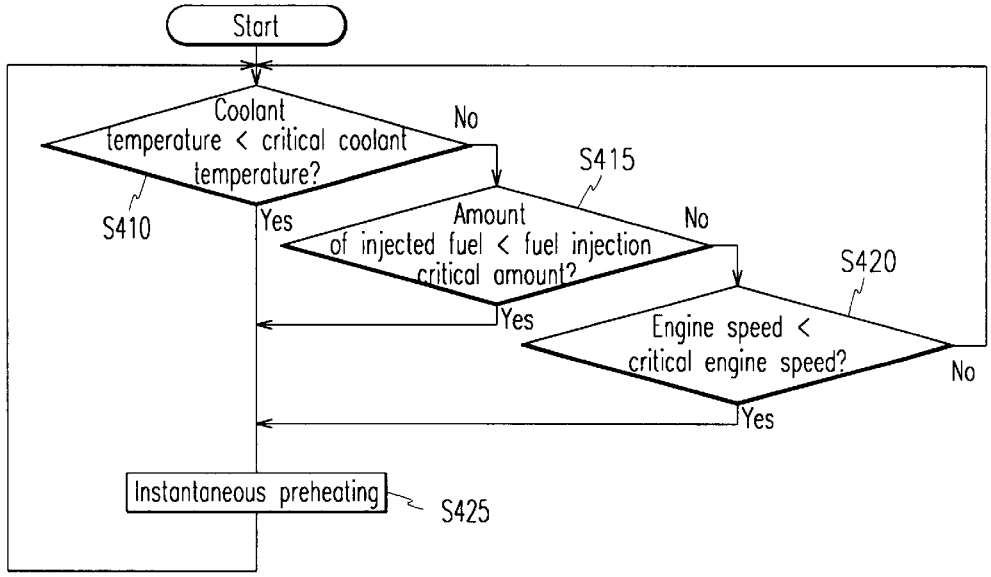

FIG. 3 and FIG. 4 are flowcharts showing respectively a detailed step of a starting glow plug control step and a running glow plug control step.

FIG. 3 is a flowchart showing detailed steps of the starting control step in an embodiment of a method for controlling the glow plug of the present invention.

If the start switch is turned to an 'on' or a 'start' state, the starting glow plug control step S210 is initiated.

If the starting glow plug control step S210 starts, the control unit 120 determines whether the coolant temperature sensor is working properly, in step S310. The determination is made by ordinary logic of an electronic control unit (ECU).

If the coolant temperature sensor is determined to be working properly in step S310, the temperature detected from the coolant temperature sensor 125 is fixed as the coolant temperature (S320). If the coolant temperature sensor is determined to be malfunctioning in step S310, a default temperature is fixed as the coolant temperature (S315). The default temperature can be fixed as a sufficiently low temperature with reference to an ordinary cold starting situation of the engine. For example, the default temperature can be fixed as −25° C.

The control unit 120, after fixing the coolant temperature, operates the relay 115 such that power is applied to the glow plug 110 from the battery 135 (S325).

After applying power to the glow plug 110, the control unit 120 measures an elapsed time of power application, and then the control unit 120 determines whether the measured time exceeds a predetermined preheating time (hereinafter called an initial preheating time) (S330).

The initial preheating time is determined by a table that uses the battery voltage and the coolant temperature as variables.

FIG. 7 is a drawing showing an example of a table that determines the initial preheating time. The initial preheating time is determined according to the coolant temperature and the battery voltage as shown in FIG. 7. The initial preheating time for a coolant temperature and a battery voltage not given in FIG. 7 can be determined by linear approximation based on the coolant temperatures and battery voltages given in FIG. 7.

As shown in FIG. 3, when the control unit 120 determines that the elapsed time for the power application is not greater than the initial preheating time, the control unit 120 determines whether the engine is being cranked (S335).

In step S335, the engine is determined to be cranking when the engine speed is greater than a predetermined speed for more than a predetermined time. The predetermined time and the predetermined speed can be set respectively as an elapsed time in which the starter motor rotates normally and an arbitrary RPM (Revolutions per Minute). By way of example, the predetermined time can be 0.5 seconds, and the predetermined speed can be 450 RPM.

If the engine is determined to be not cranking in step S335, step S330 is executed again.

If the measured time is determined to be greater than the initial preheating time in step S330, or if the engine is determined to be cranking in step S335, the initial preheating in the cranking step ends, and the preheating in the idling entrance step (hereinafter called main preheating) starts.

If the main preheating starts, the control unit 120 determines whether the measured time from power-apply start time exceeds the main preheating time (S340).

The main preheating time is determined by using a table with the coolant temperature and the battery voltage as variables, as shown in FIG. 8. The main preheating time for a coolant temperature and a battery voltage not given in FIG. 8 can be determined by linear approximation based on the coolant temperatures and the battery voltages given in FIG. 8.

As shown in FIG. 3, if, in the step of determining whether the measured time from the power-apply start time is greater than the main preheating time, the measured time is determined to be not greater than the main preheating time, the control unit 120 determines whether the engine has started idling (S345).

In the determination of entrance to the idling state (S345), if the engine speed becomes a predetermined speed, it is determined to be idling. The predetermined engine speed can be an arbitrary speed of the engine at which the electronic control unit (ECU) recognizes that starting is completed, and by way of example, the predetermined engine speed can be 800 RPM.

If the engine is determined to have not entered the idling state in step S345, the control unit 120 measures the coolant temperature and determines whether the coolant temperature is higher than a predetermined target value (S350).

The predetermined target value can be an arbitrary coolant temperature, and for example it can be 50° C.

If the coolant temperature is determined to be not higher than the predetermined target value, the step determining whether the measured time is greater than the main preheating time (S340) is executed again.

If the measured time is determined to be greater than the main preheating time in step S340, or if the engine is determined to be idling, or if the coolant temperature is determined to be higher than the predetermined target value in the step determining the coolant temperature, the control unit 120 cuts off power supplied to the relay 115 such that the power supply from the battery 135 to the glow plug 110 is cut off (S355).

After the power supply to the glow plug 110 is cut off, the control unit 120 determines whether the amount of injected fuel from an injector is greater than a predetermined fuel injection reference amount (S360).

The fuel injection reference amount can be set as a maximum amount of fuel that can be injected in a normal engine speed range, and it can be set using a fuel control device of the engine. By way of example, in an engine in which the amount of injected fuel is less than 70 $mm^3$ in all normal driving circumstances, the fuel injection reference amount can be set as 75 $mm^3$.

Generally, the amount of fuel that can normally be injected into an engine has a maximum value. Therefore, if the amount of injected fuel is determined to be greater than the fuel injection reference amount, it can be determined that the engine is cranking or it is malfunctioning.

If the amount of injected fuel is determined to be not greater than the fuel injection reference amount in step S360, it is determined whether the engine speed is greater than a predetermined reference engine speed (S365).

The reference engine speed can be set as a maximum engine speed at which the engine operates normally, and it can be set at a fuel cutoff RPM in which the electronic control unit (ECU) cuts off the fuel supply. By way of example, generally in diesel engines the reference engine speed is set at 4500 RPM.

If the engine speed is determined to be not higher than the reference engine speed in step S365, the starting control step (S210) ends.

If the amount of injected fuel is determined to be greater than the fuel injection reference amount in step S360, or if the engine speed is determined to be greater than the reference engine speed in step S365, a post-preheating step (S370) is executed.

Figure 5:
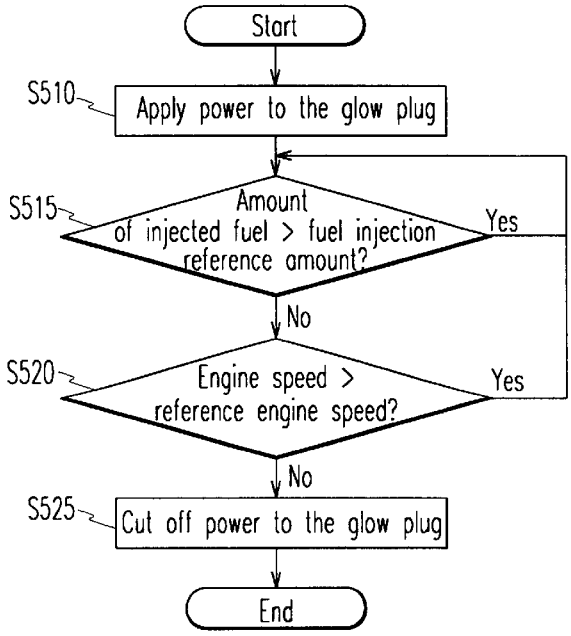
FIG. 5 and FIG. 6 are flowcharts showing respectively a detailed step of a post-preheating step and an instantaneous preheating step.

FIG. 5 is a flowchart showing detailed steps of the post-preheating step (S370).

As shown in FIG. 5, if the post-preheating step (S370) starts, the control unit 120 operates the relay 115 such that power is applied to the glow plug 110 from the battery 135 (S510).

After power is applied to the glow plug 110, the control unit 120 determines whether the amount of injected fuel from the injector is greater than the predetermined fuel injection reference amount (S515).

If the amount of injected fuel is determined to be not greater than the fuel injection reference amount in step S515, the control unit 120 determines whether the engine speed is greater than the predetermined reference engine speed (S520).

If the amount of injected fuel is determined to be greater than the fuel injection reference amount in step S515, or if the engine speed is determined to be greater than the reference engine speed in step S520, the step determining if the amount of injected fuel is greater than the fuel injection reference amount (S515) is executed again.

If the engine speed is determined to be not greater than the reference engine speed in the step S520, the control unit 120 cuts off power supplied to the relay 115 such that the power supply from the battery 135 to the glow plug 110 is cut off.

After the power supply to the glow plug 110 is cut off, the post-preheating step (S370) ends, at which point the starting control step (S210) ends, and if the starting glow plug control step (S210) ends, the running glow plug control step (S220) is executed as shown in FIG. 2.

FIG. 4 is a flowchart showing detailed steps of the running glow plug control step (S220) in an embodiment of the present invention.

If the running glow plug control step (S220) starts, the control unit 120 detects the coolant temperature and determines whether the coolant temperature is lower than a predetermined critical coolant temperature (S410).

The predetermined critical coolant temperature can be set as an arbitrary temperature by which the engine is determined to be abnormally cool. By way of example, the predetermined critical temperature can be set as −20° C.

If the coolant temperature is determined to be not lower than the critical coolant temperature in step S410, the amount of injected fuel is measured and the control unit 120 determines whether the amount of injected fuel is less than the fuel injection critical amount (S415).

The fuel injection critical amount can be set as a minimum value of the amount of fuel that can be injected at a normal engine speed range, and it can be set using a fuel control device of the engine. By way of example, the critical amount of injected fuel can be set as 10 $mm^3$.

If the amount of injected fuel is determined to be not less than the critical amount of injected fuel in step S415, the control unit 120 determines whether the engine speed is less than the critical engine speed (S420).

The critical engine speed can be set as a minimum engine speed at which the engine operates normally. By way of example, the critical engine speed can be set at 800 RPM.

If the engine speed is determined to be not less than the critical engine speed in step S420, the step determining if the coolant temperature is less than the critical coolant temperature (S410) is executed again.

If the coolant temperature is determined to be less than the critical coolant temperature in step S410, or if the amount of injected fuel is determined to be less than the fuel injection critical amount in step S415, or if the engine speed is determined to be less than the critical engine speed in the step S420, an instantaneous preheating step (S425) is executed.

Figure 6:
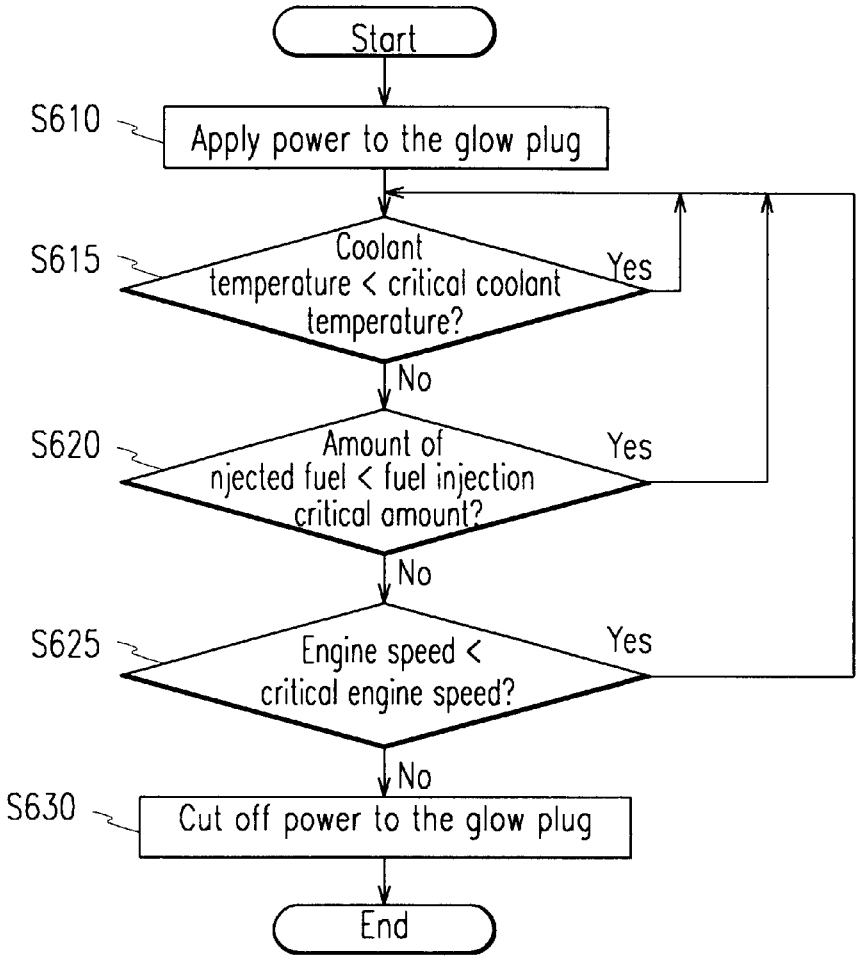

FIG. 6 is a flowchart showing detailed steps of the instantaneous preheating step (S425).

As shown in FIG. 6, if the instantaneous preheating step (S425) starts, the control unit 120 applies power to the relay 115 such that power is supplied to the glow plug 110 from the battery 135.

After power is applied to the glow plug 110, the control unit 120 measures the coolant temperature and determines whether the coolant temperature is less than the predetermined critical coolant temperature (S615).

If the coolant temperature is determined to be not lower than the critical coolant temperature in step S615, the control unit 120 determines whether the amount of injected fuel is less than the fuel injection critical amount (S620).

If the amount of injected fuel is determined to be not less than the critical amount of injected fuel in step S620, the control unit 120 determines whether the engine speed is less than the predetermined critical engine speed (S625).

If the coolant temperature is determined to be lower than the critical coolant temperature in step S615, or if the amount of injected fuel is determined to be less than the fuel injection critical amount (S620), or if the engine speed is determined to be less than the predetermined critical engine speed (S625), the step of evaluating the coolant temperature (S615) is executed again.

If the engine speed is determined to be not less than the predetermined critical engine speed in step S625, the control unit 120 cuts off the power supplied to the relay 115 such that the power supply from the battery 135 to the glow plug 110 is cut off, at which point the instantaneous preheating step (S425) ends.

If the instantaneous preheating step (S425) ends, the step of evaluating the coolant temperature (S410) is executed again as shown in FIG. 4.

Therefore, while the engine operates, continuous detection of whether instantaneous preheating is needed is performed, and in the case when instantaneous preheating is needed the instantaneous preheating can be executed.

In the detailed steps S330~S350, S410~S420, S515~S520 and S615~S625, being executed while power is supplied to the glow plug 110 in the starting glow plug control step (S210) and the running glow plug control step (S220), if the battery voltage being measured is lower than a predetermined critical voltage it is preferable that the control unit 120 stops both the power supply to the glow plug and execution of the detailed steps, and stands by until the battery voltage is higher than the critical voltage. Once it is, the control unit can resume the power supply to the glow plug and execution of the detailed steps, and it thereby allows the battery to charge when it is becomes low due to operation of the glow plug.

The critical voltage can be set as a minimum value of the battery voltage in which the starter motor of the engine can be rotated stably. By way of example, the critical voltage can be set as 8V.

The above-described preferable embodiments of the present invention are to be considered in all respects to be illustrative and not restrictive. Thus, various improvements and modifications to this invention may occur to those skilled in the art, and such improvements and modifications will fall within the scope of the present invention.

According to the embodiment of the present invention, during cold starting of an engine, the control unit divides the starting of the engine into several steps and then precisely controls starting of the engine. In addition, the control unit precisely controls the power supply to the glow plug, and thereby unnecessary power consumption can be decreased. Furthermore, if the charge of the battery is low, the control logic stops for a short time and thereby prevents an engine stall.

What is claimed is:

1. A method for controlling a glow plug of an engine, said engine being cooled by a coolant and receiving an injected fuel, said method comprising:

(a) applying power to the glow plug using a battery;

(b) maintaining the application of power until a first condition is satisfied, the first condition being that either an elapsed time of the application of power exceeds a predetermined initial preheating time or the engine is cranked;

(c) maintaining the application of power to the glow plug until a second condition is satisfied, the second condition being that either the elapsed time of the application of power exceeds a predetermined main preheating time, the engine starts idling, or a temperature of such coolant is higher than a predetermined target value;

(d) cutting off the power to the glow plug; and (e) after step (d), preheating the glow plug when an amount of such injected fuel is greater than a predetermined fuel injection reference amount or a speed of the engine is greater than a predetermined reference engine speed.

2. The method of claim 1 wherein in step (b) the initial preheating time is determined by a table that uses a voltage of the battery and the temperature of such coolant as variables.

3. The method of claim 1 wherein in step (c) the main preheating time is determined by a table that uses a voltage of the battery and the temperature of such coolant as variables.

4. The method of claim 1 wherein in step (b), when the speed of the engine is higher than a further predetermined reference engine speed for more than a predetermined time, the engine is determined to be cranking.

5. The method of claim 1 wherein in step (c), when the speed of the engine reaches a still further predetermined reference engine speed, the engine is determined to be idling.

6. The method of claim 1 wherein in step (e), preheating of the glow plug is continued until a condition is satisfied, the condition being that the amount of such injected fuel is smaller than the predetermined fuel injection reference amount and the speed of the engine is less than the predetermined reference engine speed.

7. The method of claim 1 wherein after step (d), the method further comprises a step of (f) preheating the glow plug when the temperature of such coolant is lower than a predetermined critical coolant temperature, the amount of such injected fuel is less than a predetermined critical amount of such injected fuel, or the speed of the engine is less than a predetermined critical engine speed.

8. The method of claim 7 wherein in step (f), preheating of the glow plug is continued until a condition is satisfied, the condition being that the temperature of such coolant is higher than the predetermined critical coolant temperature, the amount of such injected fuel is greater than the predetermined critical amount of such injected fuel, and the speed of the engine is greater than the predetermined critical engine speed.

9. The method of claim 8 wherein, when a voltage of the battery is lower than a predetermined critical voltage, the application of power to the glow plug and execution of steps (a) to (if) are stopped and resumed after the voltage of the battery is higher than the predetermined critical voltage.

10. The method of claim 7 wherein, when a voltage of the battery is lower than a predetermined critical voltage, the application of power to the glow plug and execution of steps (a) to (f) are stopped and resumed after the voltage of the battery is higher than the predetermined critical voltage.

11. The method of any of the claims 1–5 and 6 wherein, when a voltage of the battery is lower than a predetermined critical voltage, the application of power to the glow plug and execution of steps (a) to (e) are stopped and resumed after the voltage of the battery is higher than the predetermined critical voltage.

* * * * *

UNITED STATES PATENT AND TRADEMARK OFFICE

CERTIFICATE OF CORRECTION

PATENT NO. : 6,637,392 B2
DATED : October 28, 2003
INVENTOR(S) : Jung

It is certified that error appears in the above-identified patent and that said Letters Patent is hereby corrected as shown below:

Drawings,
Sheet 4, Fig. 6, in descriptive legend of S620, replace “njected fuel” with -- injected fuel --.

Column 10,
Line 1, replace “(if)” with -- (f) --.

Signed and Sealed this

Twelfth Day of October, 2004

JON W. DUDAS
*Director of the United States Patent and Trademark Office*